US010015618B1

(12) United States Patent
Kleijn et al.

(10) Patent No.: US 10,015,618 B1
(45) Date of Patent: Jul. 3, 2018

(54) INCOHERENT IDEMPOTENT AMBISONICS RENDERING

(71) Applicant: Google Inc., Mountain View, CA (US)

(72) Inventors: Willem Bastiaan Kleijn, Eastborne Wellington (NZ); Andrew Allen, San Jose, CA (US); Jan Skoglund, San Francisco, CA (US); Sze Chie Lim, San Francisco, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 15/666,220

(22) Filed: Aug. 1, 2017

(51) Int. Cl.
*H04R 5/02* (2006.01)
*H04S 7/00* (2006.01)
*H04S 3/00* (2006.01)

(52) U.S. Cl.
CPC ..... *H04S 7/303* (2013.01); *H04S 3/008* (2013.01); *H04S 2400/01* (2013.01); *H04S 2400/11* (2013.01); *H04S 2420/11* (2013.01)

(58) Field of Classification Search
CPC ..... H04S 7/303; H04S 3/008
See application file for complete search history.

(56) References Cited

U.S. PATENT DOCUMENTS 9,749,747 B1 * 8/2017 Kriegel ..... H04R 5/02
9,752,879 B2 * 9/2017 Al-Hamad ..... G01C 21/16
2008/0085021 A1 * 4/2008 Shim ..... A61N 1/16 381/189
2016/0073215 A1 * 3/2016 De Bruijn ..... H04S 7/308 381/17
2016/0157828 A1 * 6/2016 Sumi ..... G01N 29/0654 702/189
2016/0305782 A1 * 10/2016 Al-Hamad ..... G01C 21/16

OTHER PUBLICATIONS

Bamford, et al., "Ambisonic sound for us", Audio Engineering Society Convention 99, Audio Engineering Society, Oct. 6-9, 1995, 19 pages.

(Continued)

*Primary Examiner* — Simon King
(74) *Attorney, Agent, or Firm* — Brake Hughes Bellermann LLP

(57) ABSTRACT

Techniques of rendering sound for a listener involve producing, as the amplitude of each of the source driving signals, a sum of two terms: a first term based on a solution $s^{\dagger}$ to the equation b=A·s, and a second term based on a projection of a specified vector ŝ onto the nullspace of A, ŝ not being a solution to the equation b=A·s. Along these lines, in one example, the first term is equivalent to a Moore-Penrose pseudoinverse, e.g., $A^{H}(AA^{H})^{-1}\cdot b$. In general, any solution to the equation b=A·s is satisfactory. The specified vector that is projected onto the nullspace of A is defined to reduce the coherence of the net sound field. Advantageously, the resulting operator is both linear time-invariant and idempotent so that the sound field may be faithfully reproduce both inside the RSF and at a sufficient range outside the RSF to cover a human head.

20 Claims, 4 Drawing Sheets

(56) References Cited

OTHER PUBLICATIONS

Daniel, et al., "Ambisonics encoding of other audio formats for multiple listening conditions", Audio Engineering Society Convention 105, Audio Engineering Society, 1998, 30 pages.
Daniel, et al., "Further investigations of high-order ambisonics and wavefield synthesis for holophonic sound imaging", Audio Engineering Society Convention 114, Audio Engineering Society, Mar. 2003, 18 pages.
Dokmanic, et al., "Beyond Moore-Penrose: Sparse pseudoinverse", 2013 IEEE International Conference on Acoustics, Speech and Signal Processing, 2013, pp. 6526-6530.
Gerzon, "Ambisonics in multichannel broad-casting and video", J. Audio Eng. Soc., vol. 33, Nov. 1985, p. 859-871.
Gerzon, "Periphony: With-height sound reproduction", J. Audio Eng. Soc., vol. 21, Jan./Feb. 1973, 7 pages.
Poletti, "Three-dimensional surround sound systems based on spherical harmonics", Journal of the Audio Engineering Society, vol. 53, No. 11, 2005, pp. 1004-1025.
Solvang, "Spectral impairment of two-dimensional higher order ambisonics", Journal of the Audio engineering Society, vol. 56, No. 4, 2008, pp. 267-279.
Wabnitz, et al., "A frequency-domain algorithm to upscale ambisonic sound scenes", 2012 IEEE International conference on Acoustics, Speech and Signal Processing (ICASSP), Mar. 2012, pp. 385-388.
Wabnitz, et al., "Upscaling ambisonic sound scenes using compressed sensing techniques", 2011 IEEE Workshop on Applications of Signal Processing to Audio and Acoustics (WASPAA), Oct. 2011, pp. 1-4.
Ward, et al., "Reproduction of a plane-wave sound field using an array of loudspeakers", IEEE Transactions on speech and audio processing, vol. 9, No. 6, Sep. 2001, pp. 697-707.
Williams, "Fourier acoustics: sound radiation and nearfield acoustical holography", The Journal of the Acoustical Society of America 108 (4), Oct. 2000, pp. 1373-1374.
Zotter, et al., "Ambisonic decoding with and without mode-matching: A case study using the hemisphere", Proc. of the 2nd International Symposium on Ambisonics and Spherical Acoustics, vol. 2, May 2010, 11 pages.

* cited by examiner

INCOHERENT IDEMPOTENT AMBISONICS RENDERING

TECHNICAL FIELD

This description relates to rendering of sound fields in virtual reality (VR) and similar environments.

BACKGROUND

Ambisonics is a full-sphere surround sound technique: in addition to the horizontal plane, it covers sound sources above and below the listener. Unlike other multichannel surround formats, its transmission channels do not carry speaker signals. Instead, they contain a speaker-independent representation of a sound field called B-format, which is then decoded to the listener's speaker setup. This extra step allows the producer to think in terms of source directions rather than loudspeaker positions, and offers the listener a considerable degree of flexibility as to the layout and number of speakers used for playback.

In ambisonics, an array of virtual loudspeakers surrounding a listener generates a sound field by decoding a sound file encoded in a scheme known as B-format from a sound source that is isotropically recorded. The sound field generated at the array of virtual loudspeakers can reproduce the effect of the sound source from any vantage point relative to the listener. Such decoding can be used in the delivery of audio through headphone speakers in Virtual Reality (VR) systems via a set of head-related transfer functions (HRTFs). Binaurally rendered high-order ambisonics (HOA) refers to the creation of many virtual loudspeakers which combine to provide a pair of signals to left and right headphone speakers.

SUMMARY

In one general aspect, a method can include receiving, by controlling circuitry of a sound rendering computer configured to render directional sound fields for a listener, sound data resulting from a sound field in a geometrical environment, the sound data being represented as an expansion in a plurality of orthogonal angular mode functions based on the geometrical environment. The method can also include generating, by the controlling circuitry, a linear operator, the linear operator resulting from a mode-matching operation on the sound data and an expansion of a weighted sum of a plurality of amplitudes of loudspeakers represented as an expansion in the plurality of orthogonal angular mode functions. The method can further include performing, by the controlling circuitry, an inverse operation on the linear operator and the sound data to produce a first plurality of loudspeaker weights. The method can further include performing, by the controlling circuitry, a projection operation on a nullspace of the linear operator to produce a second plurality of loudspeaker weights. The method can further include generating, by the controlling circuitry, a sum of the first plurality of loudspeaker weights and the second plurality of loudspeaker weights to produce a third plurality of loudspeaker weights, the third plurality of loudspeaker weights providing a reproduction of the sound field for the listener.

The details of one or more implementations are set forth in the accompanying drawings and the description below. Other features will be apparent from the description and drawings, and from the claims.

DETAILED DESCRIPTION

Figure 1:
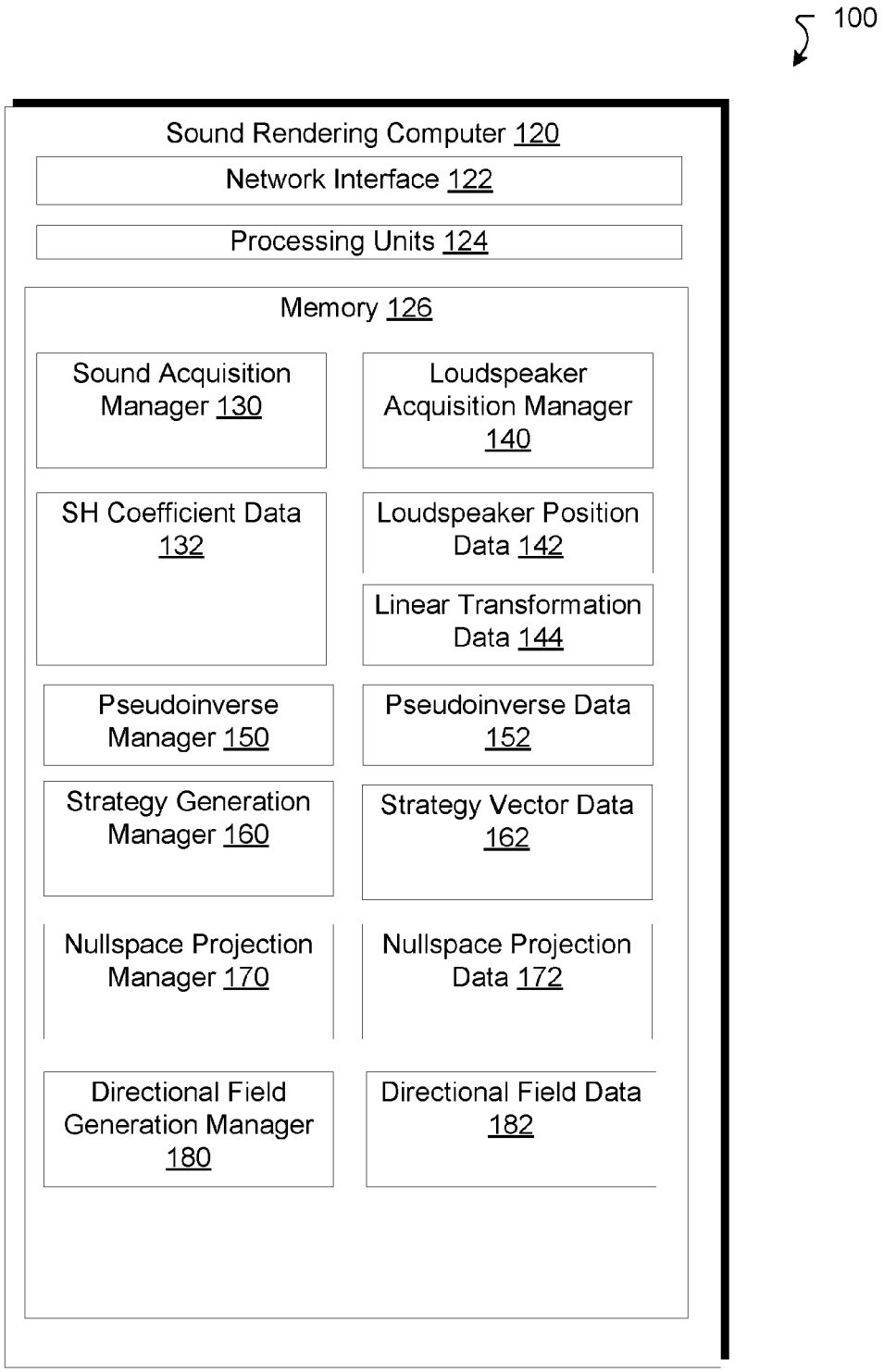
FIG. 1 is a diagram that illustrates an example electronic environment for implementing improved techniques described herein.

Some rendering of HOA sound fields involves summing a weighted sequence of components from each HOA channel and amplitudes from each source direction to produce a net sound field at a microphone. When expressed in a spherical harmonic expansion, each component of the sound field has a temporal, angular, and radial factor as determined by the wave equation in spherical coordinates. The angular factor is a spherical harmonic, while the radial factor is proportional to a spherical Bessel function.

In many cases, the amplitude of the contribution from each source direction is unknown. Rather, what is known is the net sound field at a microphone. As noted above, such a sound field may be expanded into a series of spherical harmonic modes. In addition, the contribution from each source direction, when modeled as a point source, may also be expanded into a series of spherical harmonic modes. Because the spherical harmonic modes are an orthogonal set, the amplitudes may be determined by matching the spherical harmonic modes.

Truncation of the sequence of components leads to an accurate description of the sound field within a certain radius (region of sufficient fidelity, or RSF) and below a certain frequency. For many applications, the RSF should be about the size of a human head.

Nevertheless, because the size of the RSF is inversely proportional to the frequency, for a given truncation length to N spherical harmonic orders, low frequencies will have a greater reach and therefore the signal timbre generally changes as one moves away from the origin. Increasing the number of components $T=(N+1)^2$ is an inefficient way of improving performance as, for a given frequency, the size of the RSF is approximately proportional to the square root of the number of components. Frequently, this size is smaller than the size of the human head.

An objective in rendering ambisonics then is to determine the set of Q source driving signals s that produce the T components b of the measured sound field in the RSF. The strengths, or weights, of the source driving signals s may be determined via an inversion of a linear transformation A applied to the components b, of the measured sound field i.e., $b=A\cdot s$, from which one determines s. (The linear transformation A results from the inhomogeneous Helmholtz equation and boundary conditions.) A is a $T\times Q$ matrix, in which $Q>T$, i.e., there are more sources than components, so that the resulting linear system is underdetermined and there are multiple sets of source driving signals s that produce the same sound field in the RSF.

Accordingly, one may impose a constraint on the linear system in order to uniquely determine the amplitudes of the source driving signals that best reproduce the sound field outside the RSF. Conventional approaches to rendering HOA sound fields has involved determining the source distribution by minimizing the energy of the driving signal s, i.e., according to an $L^2$ norm (i.e., sum of the squares of the components of s) subject to the condition b=A·s. According to such a conventional approach, the resulting source distribution ŝ is the Moore-Penrose (MP) pseudoinverse of the matrix times the weight vector, e.g., $A^H(AA^H)^{-1}\cdot b$, where $A^H$ is the Hermitian conjugate of A. The MP pseudoinverse forms the basis of a linear, time-invariant operator which, for some choices of source arrangements, is equal to $A^H$.

Such a conventional approach, however, results in a solution that produces unnatural sound fields due to spectral impairment outside the RSF. The reason for this is that a minimum variance objective such as the $L^2$ norm also minimizes the ability of a decoder to describe source directionality because such an objective tends to minimize the variability of the sound amplitudes over direction. Furthermore, the resulting sound field imposes coherence of the sound field. Such coherence disappears away from the microphone because the size of the RSF varies with temporal frequency.

In a natural sound field, generated by primary sound sources and their reflections, sound waves from different directions tend not to add coherently at any location. Hence, in a natural sound field the timbre generally does not vary rapidly over space. In contrast, when the objective is to reconstruct a sound field, then sound waves from large number of real or virtual loudspeakers are configured to act together. When many such loudspeakers are used, this acting together commonly leads to sound fields that have rapid variations in the timbre across space. One may refer to sound fields with such rapid variations as unnatural sound fields. An example of an unnatural sound field is the sound field that is created by loudspeaker weight calculation with the Moore-Penrose pseudoinverse. In this example, as stated above, the sound field amplitude decreases rapidly outside the RSF and as the RSF has a radius that is frequency dependent, the timbre of the sound field varies rapidly in space.

One may consider other frameworks that result in more source directionality, such as a minimization according to the $L^1$ norm (i.e., sum of the absolute values of the components of s) or a max-$r_E$ technique (i.e., maximizing the energy localization vector). Nevertheless, the $L^1$ norm does not result in a linear time-invariant operator while the max-$r_E$ technique is not idempotent (i.e., if the sound field in the RSF is estimated, the original HOA description should be recoverable). A more complex technique such as a minimization of the $L^{12}$ norm, while being linear time-invariant, can be quite resource-intensive and therefore costly to use in a real-time setting such as a virtual reality game.

In accordance with the implementations described herein and in contrast with the above-described conventional approaches to rendering HOA sound fields, improved techniques involve producing, as the amplitude of each of the source driving signals, a sum of two terms: a first term based on a solution $s^\dagger$ to the equation b=A·s, and a second term based on a projection of a specified vector ŝ onto the nullspace of A, ŝ not being a solution to the equation b=A·s. Along these lines, in one example, the first term is equivalent to a Moore-Penrose pseudoinverse, e.g., $A^H(AA^H)^{-1}\cdot b$. In general, any solution to the equation b=A·s is satisfactory. The specified vector that is projected onto the nullspace of A is defined to reduce the coherence of the net sound field. Advantageously, the resulting operator is both linear time-invariant and idempotent so that the sound field may be faithfully reproduce both inside the RSF and at a sufficient range outside the RSF to cover a human head. Further, the computations are simple enough to be performed in a real-time environment.

FIG. 1 is a diagram that illustrates an example electronic environment 100 in which the above-described improved techniques may be implemented. As shown, in FIG. 1, the example electronic environment 100 includes a sound rendering computer 120.

The sound rendering computer 120 is configured to render sound fields for a listener. The sound rendering computer 120 includes a network interface 122, one or more processing units 124, and memory 126. The network interface 122 includes, for example, Ethernet adaptors, Token Ring adaptors, and the like, for converting electronic and/or optical signals received from the network 170 to electronic form for use by the sound rendering computer 120. The set of processing units 124 include one or more processing chips and/or assemblies. The memory 126 includes both volatile memory (e.g., RAM) and non-volatile memory, such as one or more ROMs, disk drives, solid state drives, and the like. The set of processing units 124 and the memory 126 together form control circuitry, which is configured and arranged to carry out various methods and functions as described herein.

In some embodiments, one or more of the components of the sound rendering computer 120 can be, or can include processors (e.g., processing units 124) configured to process instructions stored in the memory 126. Examples of such instructions as depicted in FIG. 1 include a sound acquisition manager 130, a loudspeaker acquisition manager 140, a pseudoinverse manager 150, a strategy generation manager 160, a nullspace projection manager 170, and a directional field generation manager 180. Further, as illustrated in FIG. 1, the memory 126 is configured to store various data, which is described with respect to the respective managers that use such data.

The sound acquisition manager 130 is configured to acquire sound data 132 via a recording or software-generated audio. For example, the sound acquisition manager 130 may obtain the sound data 132 from an optical drive or over the network interface 122. Once it acquires the sound data 132, the sound acquisition manager is also configured to store the sound data 132 in memory 126. In some implementations, the sound acquisition manager 130 streams the sound data 132 over the network interface 122.

It is usually convenient to represent the sound data as an expansion in a plurality of orthogonal angular mode functions. Such an expansion into orthogonal angular mode functions depends on a geometrical environment in which the microphone is placed. For example, in some implementations that use a spherical microphone to capture sound over a sphere, the orthogonal angular mode functions are spherical harmonics. In some implementations, the geometrical environment is cylindrical and the orthogonal angular mode functions are trigonometric functions. For the ensuing discussion, it will be assumed that the orthogonal angular mode functions are spherical harmonics.

In some implementations, the sound data 132 is encoded in B-format, or first-order ambisonics with four components, or ambisonic channels. In some implementations, the sound data 132 is encoded in higher-order ambisonics, e.g., to order N. In this case, there will be $T=(N+1)^2$ ambisonic channels, each channel corresponding to a term in a spherical harmonic (SH) expansion of a sound field emanating from a set of loudspeakers. In some implementations, the sound data 132 is expressed as a truncated expansion of a pressure field $p_N$ into spherical harmonics as follows:

$$p_N(r, \hat{x}, \omega) = \sum_{n=0}^{N} \sum_{m=-n}^{n} b_n^m(\omega) j_n(kr) Y_n^m(\hat{x}), \tag{1}$$

where ω is the temporal (angular) frequency, k=ω/c is the wavenumber, c is the speed of sound waves, $j_n$ is the spherical Bessel function of the first kind, $y_n^m$ is a spherical harmonic, $\hat{x}$ is a point (θ, ϕ) on the unit sphere, and the $b_n^m$ are the (frequency-dependent) coefficients of the spherical harmonic expansion of the pressure (i.e., sound) field. Accordingly, the sound data 132 acquired by the sound acquisition manager 130 may take the form of a vector b of the coefficients $b_n^m$, where the coefficient vector b has $T=(N+1)^2$ components. In some implementations, the components of the coefficient vector b incorporates the spherical Bessel function part of the above spherical harmonic expansion.

As an aside, a spherical geometry is not required. For example, in a cylindrical geometry, one may replace the spherical Bessel functions $j_n$ with cylindrical Bessel functions $J_n$. One would also replace the spherical harmonics $Y_n^m$ with trigonometric functions.

The source acquisition manager 140 is configured to acquire the directions $\hat{x}_q$ of each of Q loudspeakers with amplitudes s. Each of the loudspeakers is considered to be a secondary source. Accordingly, each of the directions $\hat{x}_q$ are assumed to either be given or to have been deduced by some algorithm.

In some implementations, each loudspeaker (i.e., corresponding to a respective component of the loudspeaker amplitude vector s) can be modeled as a point source in three dimensions. As such, such a source at a position $x_q=r\hat{x}_q$ has an amplitude profile at an observation point x' proportional to a Green's function $$G(x_q, x') = \frac{e^{ik|x_q - x'|}}{4\pi|x_q - x'|}. \tag{2}$$

In some implementations, when the sound data 132 is the result of a recording, the loudspeakers having amplitude s are considered to be at the same distance from a microphone used to record the sound data 132. The directions $\hat{x}_q$ are then stored as loudspeaker data 142. In some implementations, the when the sound data 132 is generated by a machine, the loudspeakers having amplitude s are also considered to be at the same distance from a microphone used to record the sound data 132 and the directions $\hat{x}_q$ (either deduced separately or given) are then stored as loudspeaker data 142.

The loudspeaker acquisition manager 140 is also configured to construct a linear operator A as a T×Q matrix as linear transformation data 144 that represents the linear mode-matching equation b=A·s. That is, when the modes of the spherical harmonic expansion of the aggregate sound field due to the point sources at directions $\hat{x}_q$ having (unknown) amplitudes s are equated with the modes of the spherical harmonic expansion of the acquired sound field at the microphone b, the result is the linear mode-matching equation b=A·s. In some implementations, Q>T and the linear system is underdetermined. Accordingly, in such cases, there are many possible solutions to the linear mode-matching equation. Further details concerning the arrangement of the loudspeakers are described with regard to FIG. 2.

The pseudoinverse manager 150 is configured to generate a solution to the linear mode-matching equation b=A·s. This solution is the first term of the sound field according to the improved techniques disclosed herein. In some implementations, a solution to the linear mode-matching equation may be expressed in terms of the pseudoinverse Moore-Penrose pseudoinverse of the linear operator A. The Moore-Penrose pseudoinverse of the linear operator A, pinv(A), may be written as $$\mathrm{pinv}(A) = A^H(AA^H)^{-1}, \tag{3}$$

where $A^H$ is the Hermitian conjugate of A. This pseudoinverse is produced in the sound rendering computer 120 as pseudoinverse data 152. In this case, a solution $s^\dagger$ to the linear mode-matching equation b=A·s is then $$s^\dagger = A^H(AA^H)^{-1} \cdot b. \tag{4}$$

To generate this solution, the pseudoinverse manager 150 is configured to multiply the matrix produced in the pseudoinverse data 152 by the coefficients produced in the spherical harmonics data 132.

The strategy generation manager 160 is configured to produce as strategy vector data 162 a strategy vector $\hat{s}$ that may not satisfy the linear mode-matching equation b=A·s but rather satisfies a different criterion. To realize the advantages in the improved techniques, the strategy vector $\hat{s}$ corresponds to a sound rendering technique that has desirable behavior outside of the RSF. In some implementations, the strategy generation manager 160 defines the strategy vector § according to an optimal continuous monopole density across the sphere used for rendering the sound field.

Along these lines, consider a continuous monopole density function on the unit sphere and its expansion in spherical harmonics:

$$\mu(x') = \sum_{n=0}^{N} \sum_{m=-n}^{n} \gamma_n^m(k) Y_n^m(\theta', \phi'). \tag{5}$$

The Green's function of a monopole source is as described above in Eq. (2). Nevertheless, as disclosed above, such a Green's function may also be expressed in a spherical harmonic expansion as follows:

$$G(x, x') = \frac{e^{ik|x-x'|}}{4\pi|x-x'|} = \sum_{n=0}^{\infty} \sum_{m=-n}^{n} ikh_n^{(1)}(kr') j_n(kr) Y_n^{m*}(\theta', \phi') Y_n^m(\theta, \phi), \tag{6}$$

where $h_n^{(1)}$ is a spherical Hankel function of $n^{th}$ order. The sound field may then be expressed in terms of this Green's function in Eq. (6) as follows:

$$p_N(r,\theta,\phi,ck) = \int \mu(\theta',\phi') G(x,x') \sin\theta' d\theta' d\varphi', \tag{7}$$

where the integration is over the unit sphere. Mode matching with the spherical harmonic expansion of $p_N$ in Eq. (1) produces an expression for the coefficients of the spherical harmonic expansion of the monopole density function:

$$\gamma_n^m(k) = \frac{b_n^m(ck)}{ikh_n^{(1)}(kr')}, \tag{8}$$

where r' is the distance of an observation point from the source.

The strategy vector $\hat{s}$ may then be defined in terms of the above monopole density function:

$$\hat{s}_q=\kappa\mathbf{1}\mu(x_q)|\mu(x_q)|^{\alpha}, \tag{9}$$

where $\hat{s}_q$ is the $q^{th}$ component of the strategy vector $\hat{s}$, $\kappa$ is a normalization constant, and $\alpha\geq 0$ is a parameter that sets the strength of the directionality. For example, when $\alpha=0$, the strategy vector obtains a simple regularization of the sound field. When $\alpha>0$, the field is regularized with strengthened directionality.

The nullspace projection manager 170 is configured to produce as nullspace projection data 172 a projection $\tilde{s}$ of the strategy vector $\hat{s}$ onto the nullspace $\mathcal{N}_A$ of the linear operator A. In some implementations, the matrix $P_{\mathcal{N}_A}$ that projects onto the columns of the nullspace $\mathcal{N}_A$ of the linear operator A is given by $$P_{\mathcal{N}_A}=I-P_{A^H}, \tag{10}$$

where I is the identity matrix and $P_{A^H}$ is the projection onto the columns of $A^H$, the Hermitian conjugate of the linear operator A. Accordingly, the projection $\tilde{s}$ of the strategy vector $\hat{s}$ onto the nullspace $\mathcal{N}_A$ of the linear operator A may be expressed explicitly in terms of the linear operator A as follows:

$$\tilde{s}=(I-A^H(AA^H)^{-1}A)\hat{s}. \tag{11}$$

The directional field generation manager 180 is configured to produce, as the directional field data 182, a directional sound field s in terms of a combination of the solution $s^{\dagger}$ to the linear mode-matching equation b=A·s and the projection $\tilde{s}$ of the strategy vector $\hat{s}$ onto the nullspace $\mathcal{N}_A$ of the linear operator A. In some implementations, the directional field generation manager 180 generates, as the directional field data 182, a sum of the components of $s^{\dagger}$ in the pseudoinverse data 152 and the components of $\tilde{s}$ in nullspace projection data 172. That is, the directional sound field $$s=s^{\dagger}+\tilde{s}. \tag{12}$$

Such a sum ensures that the overall resulting linear operator is idempotent and therefore faithfully reproduces a sound field inside of the RSF. Moreover, in contrast to the pseudoinverse operator alone as in the conventional approaches, an operator resulting in the directional sound field according to the improved techniques as expressed in Eq. (12) produces a plausible sound field outside the RSF as well.

In some implementations, the memory 126 can be any type of memory such as a random-access memory, a disk drive memory, flash memory, and/or so forth. In some implementations, the memory 126 can be implemented as more than one memory component (e.g., more than one RAM component or disk drive memory) associated with the components of the sound rendering computer 120. In some implementations, the memory 126 can be a database memory. In some implementations, the memory 126 can be, or can include, a non-local memory. For example, the memory 126 can be, or can include, a memory shared by multiple devices (not shown). In some implementations, the memory 126 can be associated with a server device (not shown) within a network and configured to serve the components of the sound rendering computer 120.

The components (e.g., managers, processing units 124) of the sound rendering computer 120 can be configured to operate based on one or more platforms (e.g., one or more similar or different platforms) that can include one or more types of hardware, software, firmware, operating systems, runtime libraries, and/or so forth.

The components of the sound rendering computer 120 can be, or can include, any type of hardware and/or software configured to process attributes. In some implementations, one or more portions of the components shown in the components of the sound rendering computer 120 in FIG. 1 can be, or can include, a hardware-based module (e.g., a digital signal processor (DSP), a field programmable gate array (FPGA), a memory), a firmware module, and/or a software-based module (e.g., a module of computer code, a set of computer-readable instructions that can be executed at a computer). For example, in some implementations, one or more portions of the components of the sound rendering computer 120 can be, or can include, a software module configured for execution by at least one processor (not shown). In some implementations, the functionality of the components can be included in different modules and/or different components than those shown in FIG. 1.

In some implementations, the components of the sound rendering computer 120 (or portions thereof) can be configured to operate within a network. Thus, the components of the sound rendering computer 120 (or portions thereof) can be configured to function within various types of network environments that can include one or more devices and/or one or more server devices. For example, the network can be, or can include, a local area network (LAN), a wide area network (WAN), and/or so forth. The network can be, or can include, a wireless network and/or wireless network implemented using, for example, gateway devices, bridges, switches, and/or so forth. The network can include one or more segments and/or can have portions based on various protocols such as Internet Protocol (IP) and/or a proprietary protocol. The network can include at least a portion of the Internet.

In some embodiments, one or more of the components of the sound rendering computer 120 can be, or can include, processors configured to process instructions stored in a memory. For example, the sound acquisition manager 130 (and/or a portion thereof), the loudspeaker acquisition manager 140 (and/or a portion thereof), the pseudoinverse manager 150 (and/or a portion thereof), the strategy generation manager 160 (and/or a portion thereof), the nullspace projection manager (and/or a portion thereof), and the directional field generation manager 180 (and/or a portion thereof) can include a combination of a memory storing instructions related to a process to implement one or more functions and a configured to execute the instructions.

Figure 2:
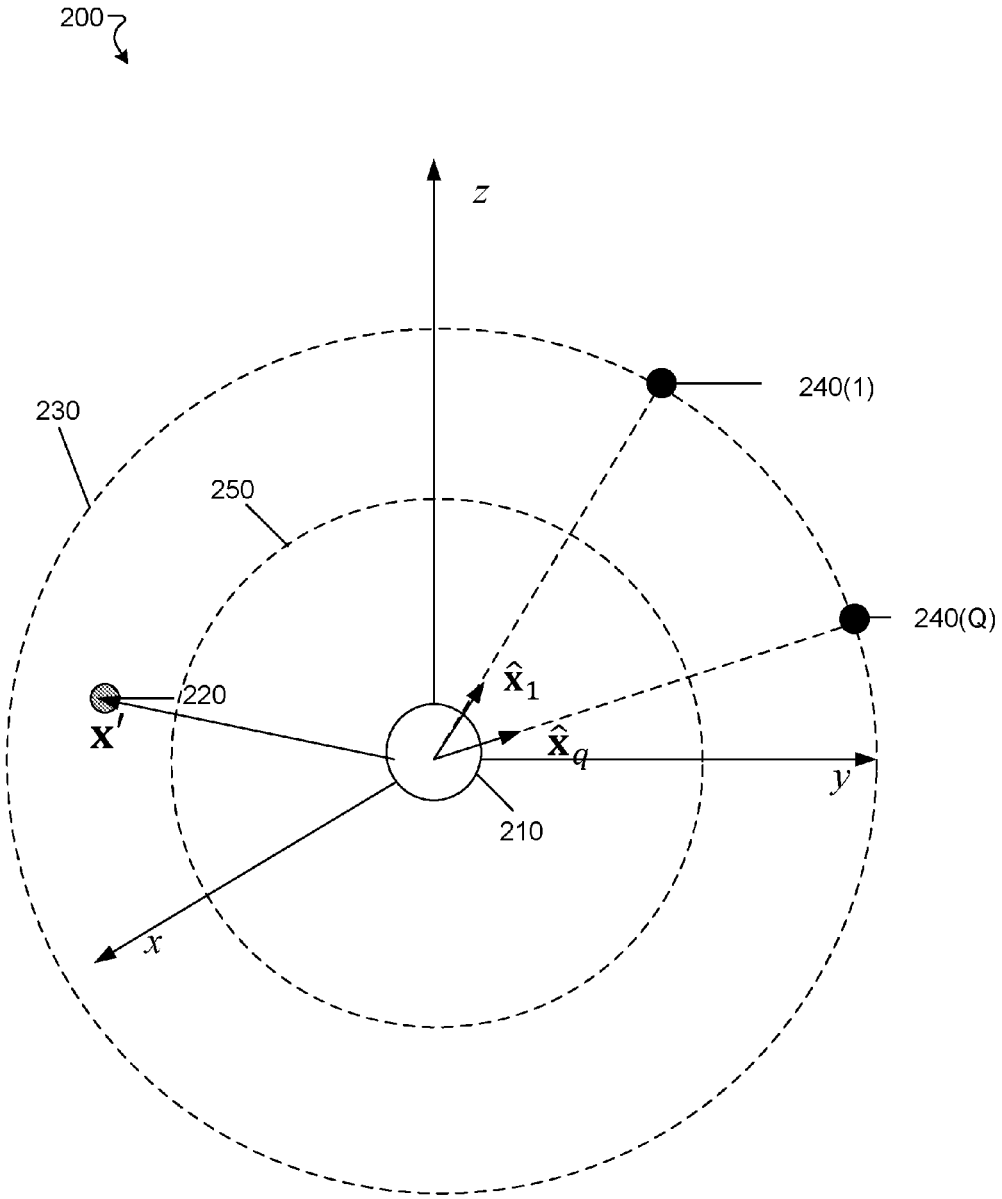
FIG. 2 is a diagram that illustrates example loudspeaker and observer positions with respect to a microphone according to the improved techniques described herein.

FIG. 2 illustrates an example sound field environment 200 according to the improved techniques. Within this environment 200, there is an origin 210 (open disk) at which a listener might be located at the center of a set of real or virtual loudspeakers, e.g., loudspeaker 240(1), . . . , 240(Q) (filled disks) distributed over a sphere 230 centered at the microphone 210. Each loudspeaker, e.g., loudspeaker 240 (1), is located along the direction $\hat{x}_1$, and so on. In some arrangements, there might be a spherical microphone at the origin 210 that measures and records sound field amplitudes as a function of direction away from the origin for the listener to hear at the origin.

The sound rendering computer 120 is configured to faithfully reproduce the sound field that would exist at an observation point 220 (gray disk) based on sound field data 132 recorded at the origin 210. In doing this, the sound rendering computer 120 is configured to provide a directionality of the sound field at the observation point 220 by determining the amplitudes of the sound field at each of the set of loudspeakers 240(1), . . . , 240(Q) as discussed above. The directionality of the sound field is a property that allows a listener to discern from which direction a particular sound appears to originate. In this sense, a first sample of the sound field over a first window of time (e.g., one second) would result in first weights for the set of loudspeakers 240(1), . . . , 240(Q), a second sample of the sound field over a second window of time would result in a second weights, and so on. For each sample of the sound field over a window of time, the coefficients of the sound field over frequency as expressed in Eq. (1) are Fourier transforms of the coefficients of the spherical harmonic expansion of the sound field in time.

As shown in FIG. 2, the observation point 220 is at a position $x'=r'\hat{x}'$ with respect to the microphone 210. The position x' of the observation point 220 is outside of a region of sufficient fidelity (RSF) 250 but inside a region 230 defined by the set of loudspeakers 240(1), . . . , 240(Q). The size of the RSF 250 depends on the frequency, but for most frequencies of interest the observation point 220 is inside the RSF 250. In some implementations, the size R of the RSF 250 is defined such that $\lceil kR \rceil = N$. A common situation involves a listener's ears being outside of the RSF 250.

Accordingly, when the sound field includes a spectrum of different frequencies, the RSF 250 may vary in size, i.e., the size R of the RSF 250 is inversely proportional to the frequency because $\lceil kR \rceil = N$. For example, a single-frequency, coherent sound field as in, for example, Eq. (4) is described by a solution to the linear mode-matching equation $b=A\cdot s$. Nevertheless, because of the frequency dependence of the size of the RSF 250, such a coherent sound field does not provide sufficient fidelity to the actual sound field that includes multiple frequencies heard at the observation point 220 outside of the RSF. Rather, it has been found that the projection of a strategy vector onto a nullspace of the linear operator A as in Eq. (12) makes the sound field incoherent. Such incoherence provides much better fidelity to the sound field than that provided by the solution to the linear mode-matching equation $b=A\cdot s$ as in Eq. (4) alone. The reason for this is that the incoherence of the sound field removes the frequency dependence of the size of the RSF 250 and thereby improves a spectral fidelity to the sound field. Furthermore, the raising of the magnitude of the incoherent portion of the sound field to a power provides the directionality lacking in the solution to the linear mode-matching equation alone.

Figure 3:
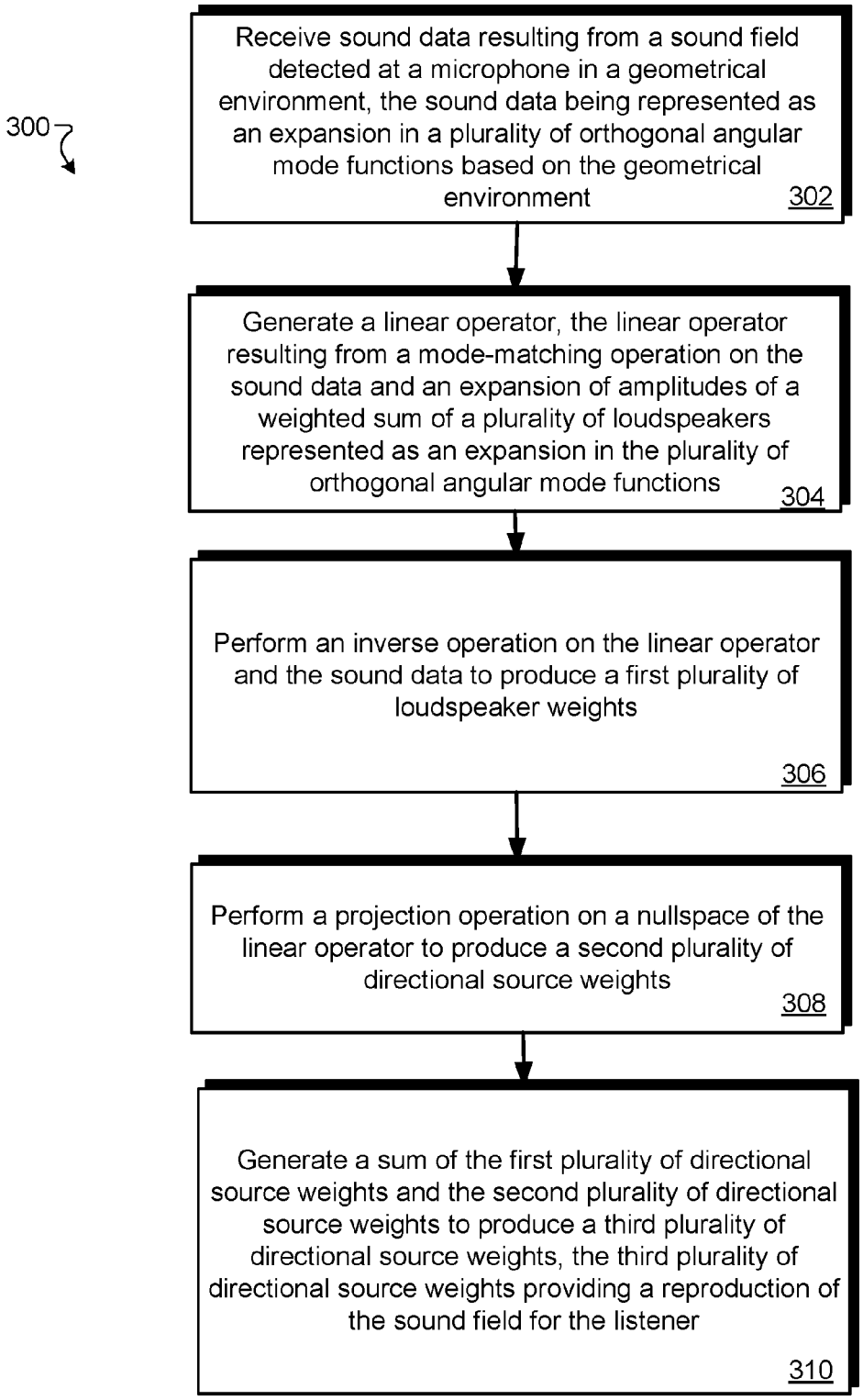
FIG. 3 is a flow chart that illustrates an example method of performing the improved techniques within the electronic environment shown in FIG. 1.

FIG. 3 is a flow chart that illustrates an example method 300 of performing binaural rendering of sound. The method 300 may be performed by software constructs described in connection with FIG. 1, which reside in memory 126 of the sound rendering computer 120 and are run by the set of processing units 124.

At 302, controlling circuitry of a sound rendering computer configured to render directional sound fields for a listener receives sound data resulting from a sound field in a geometrical environment, the sound data being represented as an expansion in a plurality of orthogonal angular mode functions based on the geometrical environment. Along these lines, the sound acquisition manager 130 receives, as input from a disk or over a network (the latter in environments such as a virtual reality environment that processes directional sound fields in real time), data representing a sound field at a real or virtual microphone. This sound field may then be decomposed into a spherical harmonic expansion as in Eq. (1), resulting in the coefficient vector b stored as spherical harmonic data 132.

At 304, the controlling circuitry generates a linear operator, the linear operator resulting from a mode-matching operation on the sound data and an expansion of a weighted sum of a plurality of amplitudes of loudspeakers represented as an expansion in the plurality of orthogonal angular mode functions. Along these lines, the loudspeaker acquisition manager 140 obtains loudspeaker directions (e.g., from a separate procedure or specification) $\hat{x}_q$ of each of Q loudspeakers as loudspeaker position data 142. Given these directions, the loudspeaker acquisition manager 140 may then generate the linear operator A as linear transformation data 144 by mode-matching the spherical harmonic expansion in Eq. (6) for each loudspeaker with the spherical harmonic expansion in Eq. (1).

At 306, the controlling circuitry performs a pseudoinverse operation on the linear operator and the sound data to produce a first plurality of loudspeaker weights, the first plurality of loudspeaker weights providing a reproduction of the sound field for the listener at frequencies less than a frequency threshold. In some implementations, the pseudoinverse manager 150 produces a Moore-Penrose pseudoinverse as specified in Eq. (3) and multiplies this pseudoinverse by the coefficient vector b stored as spherical harmonic data 132 to produce, as the pseudoinverse data 152, the solution $s^{\dagger}$ to the linear mode-matching equation $b=A\cdot s$.

At 308, the controlling circuitry performs a projection operation on a nullspace of the linear operator to produce a second plurality of loudspeaker weights. Along these lines, the controlling circuitry may generate a second sound field term $\hat{s}$ that is not a solution to the equation $b=A\cdot s$, the second sound field term $\hat{s}$ having Q components. For example, in the enhanced monopole density strategy described above, the strategy generation manager 160 produces, as each of the Q components of the strategy vector data 162, a component value according to Eq. (9) using the expression for the monopole density in Eq. (5) and Eq. (8). In some implementations, the strategy generation manager 160 tunes the parameter $\alpha$ for optimal directional strength. The controlling circuitry may then perform a projection operation on the second sound field term $\hat{s}$ to produce a projection of the second sound field term $\hat{s}$ onto a nullspace of the specified $T\times Q$ matrix A. Along these lines, the nullspace projection manager 170 uses the linear transformation data 144 and, in some implementations, the pseudoinverse data 152, to generate the projection onto the columns of the Hermitian conjugate $A^H$ and then multiply a difference between the identity matrix and this projection by the strategy vector $\hat{s}$ according to Eq. (11) to produce the nullspace projection data 172.

At 310, the controlling circuitry generates a sum of the first plurality of loudspeaker weights and the second plurality of loudspeaker weights to produce a third plurality of loudspeaker weights, the third plurality of loudspeaker weights providing a reproduction of the sound field for the listener at frequencies less than and greater than the frequency threshold. Along these lines, the directional field manager 180 sums the solution $s^{\dagger}$ to the linear mode-matching equation $b=A\cdot s$ as stored in the pseudoinverse data 152 and the projection $\tilde{s}$ of the strategy vector $\hat{s}$ onto the nullspace $\mathcal{N}_A$ of the linear operator A stored in the nullspace projection data 172 to produce the directional field data 182 according to Eq. (12). It is this directional field data 182 that is used by the sound rendering computer 120 to provide directional sound to a listener at the microphone position 210 (FIG. 2), or any other position in an environment (well within the convex hull defined by the positions of the plurality of loudspeakers) such as a virtual reality environment in which the listener desires to know from which direction a sound appears to originate.

Figure 4:
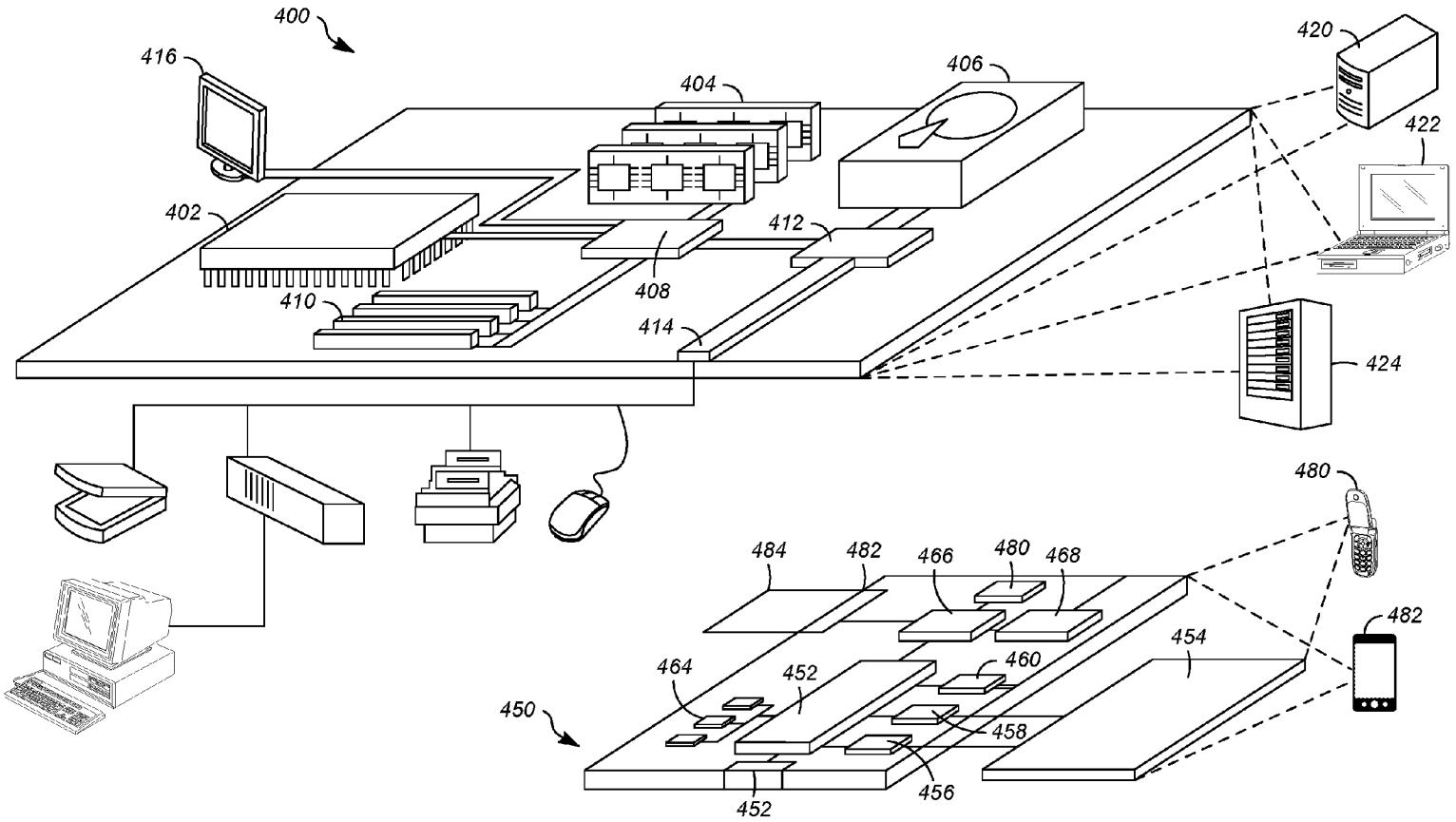
FIG. 4 illustrates an example of a computer device and a mobile computer device that can be used with circuits described here.

FIG. 4 shows an example of a generic computer device 400 and a generic mobile computer device 450, which may be used with the techniques described here. Computing device 400 is intended to represent various forms of digital computers, such as laptops, desktops, tablets, workstations, personal digital assistants, televisions, servers, blade servers, mainframes, and other appropriate computing devices. Computing device 450 is intended to represent various forms of mobile devices, such as personal digital assistants, cellular telephones, smart phones, and other similar computing devices. The components shown here, their connections and relationships, and their functions, are meant to be exemplary only, and are not meant to limit implementations of the inventions described and/or claimed in this document.

Computing device 400 includes a processor 402, memory 404, a storage device 406, a high-speed interface 408 connecting to memory 404 and high-speed expansion ports 410, and a low speed interface 412 connecting to low speed bus 414 and storage device 406. The processor 402 can be a semiconductor-based processor. The memory 404 can be a semiconductor-based memory. Each of the components 402, 404, 406, 408, 410, and 412, are interconnected using various busses, and may be mounted on a common motherboard or in other manners as appropriate. The processor 402 can process instructions for execution within the computing device 400, including instructions stored in the memory 404 or on the storage device 406 to display graphical information for a GUI on an external input/output device, such as display 416 coupled to high speed interface 408. In other implementations, multiple processors and/or multiple buses may be used, as appropriate, along with multiple memories and types of memory. Also, multiple computing devices 400 may be connected, with each device providing portions of the necessary operations (e.g., as a server bank, a group of blade servers, or a multi-processor system).

The memory 404 stores information within the computing device 400. In one implementation, the memory 404 is a volatile memory unit or units. In another implementation, the memory 404 is a non-volatile memory unit or units. The memory 404 may also be another form of computer-readable medium, such as a magnetic or optical disk.

The storage device 406 is capable of providing mass storage for the computing device 400. In one implementation, the storage device 406 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 404, the storage device 406, or memory on processor 402.

The high speed controller 408 manages bandwidth-intensive operations for the computing device 400, while the low speed controller 412 manages lower bandwidth-intensive operations. Such allocation of functions is exemplary only. In one implementation, the high-speed controller 408 is coupled to memory 404, display 416 (e.g., through a graphics processor or accelerator), and to high-speed expansion ports 410, which may accept various expansion cards (not shown). In the implementation, low-speed controller 412 is coupled to storage device 406 and low-speed expansion port 414. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 400 may be implemented in a number of different forms, as shown in the figure. For example, it may be implemented as a standard server 420, or multiple times in a group of such servers. It may also be implemented as part of a rack server system 424. In addition, it may be implemented in a personal computer such as a laptop computer 422. Alternatively, components from computing device 400 may be combined with other components in a mobile device (not shown), such as device 450. Each of such devices may contain one or more of computing device 400, 450, and an entire system may be made up of multiple computing devices 400, 450 communicating with each other.

Computing device 450 includes a processor 452, memory 464, an input/output device such as a display 454, a communication interface 466, and a transceiver 468, among other components. The device 450 may also be provided with a storage device, such as a microdrive or other device, to provide additional storage. Each of the components 450, 452, 464, 454, 466, and 468, are interconnected using various buses, and several of the components may be mounted on a common motherboard or in other manners as appropriate.

The processor 452 can execute instructions within the computing device 450, including instructions stored in the memory 464. The processor may be implemented as a chipset of chips that include separate and multiple analog and digital processors. The processor may provide, for example, for coordination of the other components of the device 450, such as control of user interfaces, applications run by device 450, and wireless communication by device 450.

Processor 452 may communicate with a user through control interface 458 and display interface 456 coupled to a display 454. The display 454 may be, for example, a TFT LCD (Thin-Film-Transistor Liquid Crystal Display) or an OLED (Organic Light Emitting Diode) display, or other appropriate display technology. The display interface 456 may comprise appropriate circuitry for driving the display 454 to present graphical and other information to a user. The control interface 458 may receive commands from a user and convert them for submission to the processor 452. In addition, an external interface 462 may be provided in communication with processor 452, so as to enable near area communication of device 450 with other devices. External interface 462 may provide, for example, for wired communication in some implementations, or for wireless communication in other implementations, and multiple interfaces may also be used.

The memory 464 stores information within the computing device 450. The memory 464 can be implemented as one or more of a computer-readable medium or media, a volatile memory unit or units, or a non-volatile memory unit or units. Expansion memory 474 may also be provided and connected to device 450 through expansion interface 472, which may include, for example, a SIMM (Single In Line Memory Module) card interface. Such expansion memory 474 may provide extra storage space for device 450, or may also store applications or other information for device 450. Specifically, expansion memory 474 may include instructions to carry out or supplement the processes described above, and may include secure information also. Thus, for example, expansion memory 474 may be provide as a security module for device 450, and may be programmed with instructions that permit secure use of device 450. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 464, expansion memory 474, or memory on processor 452 that may be received, for example, over transceiver 468 or external interface 462.

Device 450 may communicate wirelessly through communication interface 466, which may include digital signal processing circuitry where necessary. Communication interface 466 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 468. In addition, short-range communication may occur, such as using a Bluetooth, Wi-Fi, or other such transceiver (not shown). In addition, GPS (Global Positioning System) receiver module 470 may provide additional navigation- and location-related wireless data to device 450, which may be used as appropriate by applications running on device 450.

Device 450 may also communicate audibly using audio codec 460, which may receive spoken information from a user and convert it to usable digital information. Audio codec 460 may likewise generate audible sound for a user, such as through a speaker, e.g., in a handset of device 450. Such sound may include sound from voice telephone calls, may include recorded sound (e.g., voice messages, music files, etc.) and may also include sound generated by applications operating on device 450.

The computing device 450 may be implemented in a number of different forms, as shown in the figure. For example, it may be implemented as a cellular telephone 480. It may also be implemented as part of a smart phone 482, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

In this specification and the appended claims, the singular forms "a," "an" and "the" do not exclude the plural reference unless the context clearly dictates otherwise. Further, conjunctions such as "and," "or," and "and/or" are inclusive unless the context clearly dictates otherwise. For example, "A and/or B" includes A alone, B alone, and A with B. Further, connecting lines or connectors shown in the various figures presented are intended to represent exemplary functional relationships and/or physical or logical couplings between the various elements. Many alternative or additional functional relationships, physical connections or logical connections may be present in a practical device. Moreover, no item or component is essential to the practice of the embodiments disclosed herein unless the element is specifically described as "essential" or "critical".

Terms such as, but not limited to, approximately, substantially, generally, etc. are used herein to indicate that a precise value or range thereof is not required and need not be specified. As used herein, the terms discussed above will have ready and instant meaning to one of ordinary skill in the art.

Moreover, use of terms such as up, down, top, bottom, side, end, front, back, etc. herein are used with reference to a currently considered or illustrated orientation. If they are considered with respect to another orientation, it should be understood that such terms must be correspondingly modified.

Further, in this specification and the appended claims, the singular forms "a," "an" and "the" do not exclude the plural reference unless the context clearly dictates otherwise. Moreover, conjunctions such as "and," "or," and "and/or" are inclusive unless the context clearly dictates otherwise. For example, "A and/or B" includes A alone, B alone, and A with B.

Although certain example methods, apparatuses and articles of manufacture have been described herein, the scope of coverage of this patent is not limited thereto. It is to be understood that terminology employed herein is for the purpose of describing particular aspects, and is not intended to be limiting. On the contrary, this patent covers all methods, apparatus and articles of manufacture fairly falling within the scope of the claims of this patent.

What is claimed is:

1. A method, comprising:

receiving, by controlling circuitry of a sound rendering computer configured to render directional sound fields for a listener, sound data resulting from a sound field in a geometrical environment, the sound data being represented as an expansion in a plurality of orthogonal angular mode functions based on the geometrical environment;

generating, by the controlling circuitry, a linear operator, the linear operator resulting from a mode-matching operation on the sound data and an expansion of a weighted sum of amplitudes of a plurality of loudspeakers represented as an expansion in the plurality of orthogonal angular mode functions;

performing, by the controlling circuitry, an inverse operation on the linear operator and the sound data to produce a first plurality of loudspeaker weights;

performing, by the controlling circuitry, a projection operation on a nullspace of the linear operator to produce a second plurality of loudspeaker weights; and generating, by the controlling circuitry, a sum of the first plurality of loudspeaker weights and the second plurality of loudspeaker weights to produce a third plurality of loudspeaker weights, the third plurality of loudspeaker weights providing a reproduction of the sound field for the listener.

2. The method as in claim 1, wherein performing the inverse operation on the linear operator and the sound data includes producing a Moore-Penrose pseudoinverse of the linear operator.

3. The method as in claim 1, wherein the geometrical environment is spherical, and the plurality of orthogonal angular mode functions includes spherical harmonics.

4. The method as in claim 1, wherein the number of loudspeakers in the plurality of loudspeakers is greater than the number of orthogonal angular mode functions in the plurality of orthogonal angular mode functions.

5. The method as in claim 1, wherein performing the projection operation on the nullspace of the linear operator includes generating a strategy vector, each component of the strategy vector corresponding to a respective loudspeaker of the plurality of loudspeakers;

generating a difference between an identity matrix and a projection onto columns of a nullspace of a Hermitian conjugate of the linear operator to produce a projection matrix and producing, as the second plurality of loudspeaker weights, a product of the projection matrix and the strategy vector.

6. The method as in claim 5, wherein generating the strategy vector includes, for each of the plurality of loudspeakers:

defining a continuous monopole density function evaluated at a respective angular coordinate of that loudspeaker within the geometrical environment; and producing, as the strategy vector, a power of a magnitude of the continuous monopole density function evaluated at the respective angular coordinate of that loudspeaker within the geometrical environment, the power being greater than one.

7. The method as in claim 6, wherein defining the continuous monopole density function evaluated at a respective angular coordinate of each of the plurality of loudspeakers within the geometrical environment includes:

producing, as the continuous monopole density function evaluated at the angular coordinate of that loudspeaker within the geometrical environment, an expansion of the continuous monopole density function in the plurality of orthogonal angular mode functions, coefficients of the expansion being produced as a result of a mode-matching operation with a Green's function representation of the continuous monopole density function.

8. A computer program product comprising a non-transitory storage medium, the computer program product including code that, when executed by processing circuitry of a sound rendering computer configured to render directional sound fields for a listener, causes the processing circuitry to perform a method, the method comprising:

receiving sound data resulting from a sound field in a geometrical environment, the sound data being represented as an expansion in a plurality of orthogonal angular mode functions based on the geometrical environment;

generating a linear operator, the linear operator resulting from a mode-matching operation on the sound data and an expansion of a weighted sum of amplitudes of a plurality of loudspeakers represented as an expansion in the plurality of orthogonal angular mode functions;

performing an inverse operation on the linear operator and the sound data to produce a first plurality of loudspeaker weights;

performing a projection operation on a nullspace of the linear operator to produce a second plurality of loudspeaker weights; and generating a sum of the first plurality of loudspeaker weights and the second plurality of loudspeaker weights to produce a third plurality of loudspeaker weights, the third plurality of loudspeaker weights providing a reproduction of the sound field for the listener.

9. The computer program product as in claim 8, wherein performing the inverse operation on the linear operator and the sound data includes producing a Moore-Penrose pseudoinverse of the linear operator.

10. The computer program product as in claim 8, wherein the geometrical environment is spherical, and the plurality of orthogonal angular mode functions includes spherical harmonics.

11. The computer program product as in claim 8, wherein the number of loudspeakers in the plurality of loudspeakers is greater than the number of orthogonal angular mode functions in the plurality of orthogonal angular mode functions.

12. The computer program product as in claim 8, wherein performing the projection operation on the nullspace of the linear operator includes generating a strategy vector, each component of the strategy vector corresponding to a respective loudspeaker of the plurality of loudspeakers;

generating a difference between an identity matrix and a projection onto columns of a nullspace of a Hermitian conjugate of the linear operator to produce a projection matrix and producing, as the second plurality of loudspeaker weights, a product of the projection matrix and the strategy vector.

13. The computer program product as in claim 12, wherein generating the strategy vector includes, for each of the plurality of loudspeaker:

defining a continuous monopole density function evaluated at a respective angular coordinate of that loudspeaker within the geometrical environment; and producing, as the strategy vector, a power of a magnitude of the continuous monopole density function evaluated at the respective angular coordinate of that loudspeaker within the geometrical environment, the power being greater than one.

14. The computer program product as in claim 13, wherein defining the continuous monopole density function evaluated at a respective angular coordinate of each of the plurality of loudspeakers within the geometrical environment includes:

producing, as the continuous monopole density function evaluated at the angular coordinate of that loudspeaker within the geometrical environment, an expansion of the continuous monopole density function in the plurality of orthogonal angular mode functions, coefficients of the expansion being produced as a result of a mode-matching operation with a Green's function representation of the continuous monopole density function.

15. An electronic apparatus configured to render directional sound fields for a listener, the electronic apparatus comprising:

memory; and controlling circuitry coupled to the memory, the controlling circuitry being configured to:

receive sound data resulting from a sound field in a geometrical environment, the sound data being represented as an expansion in a plurality of orthogonal angular mode functions based on the geometrical environment;

generate a linear operator, the linear operator resulting from a mode-matching operation on the sound data and an expansion of a weighted sum of amplitudes of a plurality of loudspeakers represented as an expansion in the plurality of orthogonal angular mode functions;

perform an inverse operation on the linear operator and the sound data to produce a first plurality of loudspeaker weights;

perform a projection operation on a nullspace of the linear operator to produce a second plurality of loudspeaker weights; and generate a sum of the first plurality of loudspeaker weights and the second plurality of loudspeaker weights to produce a third plurality of loudspeaker weights, the third plurality of loudspeaker weights providing a reproduction of the sound field for the listener.

16. The electronic apparatus as in claim 15, wherein performing the pseudoinverse operation on the linear operator and the sound data includes producing a Moore-Penrose pseudoinverse of the linear operator.

17. The electronic apparatus as in claim 15, wherein the geometrical environment is spherical, and the plurality of orthogonal angular mode functions includes spherical harmonics.

18. The electronic apparatus as in claim 15, wherein the number of loudspeakers in the plurality of loudspeakers is greater than the number of orthogonal angular mode functions in the plurality of orthogonal angular mode functions.

19. The electronic apparatus as in claim 15, performing the projection operation on the nullspace of the linear operator includes generating a strategy vector, each component of the strategy vector corresponding to a respective loudspeaker of the plurality of loudspeakers;

generating a difference between an identity matrix and a projection onto columns of a nullspace of a Hermitian conjugate of the linear operator to produce a projection matrix and producing, as the second plurality of loudspeaker weights, a product of the projection matrix and the strategy vector.

20. The electronic apparatus as in claim 19, wherein generating the strategy vector includes, for each of the plurality of loudspeakers:

defining a continuous monopole density function evaluated at a respective angular coordinate of that loudspeaker within the geometrical environment; and producing, as the strategy vector, a power of a magnitude of the continuous monopole density function evaluated at the respective angular coordinate of that loudspeaker within the geometrical environment, the power being greater than one.

* * * * *